US009895788B2

(12) United States Patent
Kubiš et al.

(10) Patent No.: US 9,895,788 B2
(45) Date of Patent: Feb. 20, 2018

(54) DEVICE FOR MIXING SOLID PARTICLES OF DRY ICE WITH FLOW OF GASEOUS MEDIUM

(71) Applicant: ICS ICE CLEANING SYSTEMS S.R.O., Považská Bystrica (SK)

(72) Inventors: Ivan Kubiš, Považská Bystrica (SK); L'udovit Bakala, Považská Bystrica (SK); Peter Gabriš, Považská Bystrica (SK)

(73) Assignee: ICS ICE CLEANING SYSTEMS S.R.O. (SK)

( * ) Notice: Subject to any disclaimer, the term of this patent is extended or adjusted under 35 U.S.C. 154(b) by 0 days.

(21) Appl. No.: 14/889,348

(22) PCT Filed: May 6, 2013

(86) PCT No.: PCT/SK2013/050001

§ 371 (c)(1),
(2) Date: Nov. 5, 2015

(87) PCT Pub. No.: WO2014/182253

PCT Pub. Date: Nov. 13, 2014

(65) Prior Publication Data

US 2016/0121456 A1 May 5, 2016

(51) Int. Cl.
*B24C 1/00* (2006.01)
*B24C 7/00* (2006.01)

(52) U.S. Cl.
CPC ..... *B24C 1/003* (2013.01); *B24C 7/0038* (2013.01); *B24C 7/0069* (2013.01); *B24C 7/0092* (2013.01)

(58) Field of Classification Search
CPC ..... B24C 1/003; B24C 7/0038; B24C 7/0069; B24C 7/0092; B65G 53/16
See application file for complete search history.

(56) References Cited

U.S. PATENT DOCUMENTS 4,617,064 A * 10/1986 Moore ..... B24C 1/003 134/11
4,947,592 A * 8/1990 Lloyd ..... B24C 1/003 134/7

(Continued)

FOREIGN PATENT DOCUMENTS

CA CN 2801303 8/2006
EP 1 637 282 A1 3/2006

(Continued)

OTHER PUBLICATIONS

International Search Report dated Sep. 25, 2013 issued in corresponding International patent application No. PCT/SK2013/050001.

*Primary Examiner* — Timothy V Eley
(74) *Attorney, Agent, or Firm* — Ostrolenk Faber LLP

(57) ABSTRACT

Device for mixing solid particles of dry ice and the flow of gaseous medium including a feeding element (2) rotatively placed within the fixed housing (1) having openings (12, 13) for the flow of gaseous medium and/or the flow of gaseous medium with solid particles. Between the fixed housing (1) and rotatively placed feeding element (2) the immovable elastic membrane (3) is placed. The fixed housing (1) is at the side of the elastic membrane (3) provided by at least one sealed pressure chamber (14) connected with the opening (13) for the flow of gaseous medium and/or the opening (12) for the flow of gaseous medium with solid particles.

2 Claims, 3 Drawing Sheets

(56) References Cited

U.S. PATENT DOCUMENTS

| | | | | |
|---|---|---|---|---|
| 4,974,592 | A | 12/1990 | Branco | |
| 6,346,035 | B1 | 2/2002 | Anderson et al. | |
| 7,112,120 | B2 * | 9/2006 | Rivir | B24C 1/003 222/170 |
| 7,666,066 | B2 * | 2/2010 | Becker | B24C 1/003 134/7 |
| 7,775,857 | B2 | 8/2010 | Jonkheijm | 451/40 |
| 2003/0224704 | A1 * | 12/2003 | Shank | B24C 7/0092 451/38 |
| 2008/0013399 | A1 | 1/2008 | Jonkheijm | 366/97 |
| 2016/0257506 | A1 * | 9/2016 | Mallaley | B65G 53/16 |

FOREIGN PATENT DOCUMENTS

| | | | |
|---|---|---|---|
| EP | 1878537 | A1 | 1/2008 |
| NL | 1015216 | C2 | 11/2001 |
| WO | WO 8600833 | | 2/1986 |

* cited by examiner

DEVICE FOR MIXING SOLID PARTICLES OF DRY ICE WITH FLOW OF GASEOUS MEDIUM

CROSS REFERENCE TO RELATED APPLICATIONS

The present application is a 35 U.S.C. §371 National Phase conversion of PCT/SK2013/050001, filed May 6, 2013, the disclosure of which is incorporated herein by reference. The PCT International Application was published in the English language.

TECHNICAL FIELD

The invention relates to a device for mixing solid particles of dry ice, i.e. carbon dioxide ($CO_2$) in solid state, and a flow of gaseous medium, usually compressed air, especially for cleaning machines utilizing dry ice as cleaning medium.

In particular, the invention relates to the device for mixing solid particles of dry ice and the flow of gaseous medium, which comprises fixed housing wherein rotating feeding element is placed.

BACKGROUND ART

Machines for dry ice cleaning make use of mixing devices, into which dry ice granulate and pressurized gaseous medium, usually compressed air, are supplied separately in order to create a stream of dry ice.

This technical solution relates to devices, which comprise fixed housing wherein rotating feeding element is placed. In such devices, rotating element is in the form of rotating feeding disk, or in the form of rotating feeding roller. Devices comprising the rotating feeding disk as rotating feeding element are described e.g. in documents NL 1015216 C2, WO 8600833, U.S. Pat. No. 6,346,035 and EP 1 637 282 A1. Devices comprising the rotating feeding roller as rotating feeding element are described e.g. in documents U.S. Pat. No. 4,974,592 and CN 2801303.

The device serves for mechanical transport of dry ice granulate into a system with the flow of gaseous medium (air), whereas mixing of dry ice with the flow of air and creation of dry ice stream occur, mainly for cleaning purposes. Both the systems, i.e. the inlet of dry ice stored in a container and the inlet of compressed air, have different pressure. It is important to maintain tightness of the air system, for correct function and efficiency of the device. Mechanical transport of dry ice granulate is carried out by rotating feeding element, which comprises transporting cavities. Cavities filed with granulate from the container are moved by rotation of the feeding element to the system with the flow of air, and granulate is then carried by this flow of air away, whereby transporting cavities are discharged. Remaining pressure from the air system, left in the cavity after its discharge and before refilling the cavity, is equalized through pressure release channels to ambient pressure.

As it was mentioned above, it is important to maintain tightness of the air system for correct function and efficiency of the device. In the case of devices with feeding disk, the tightness is obtained by forcing the fixed plates against the rotating feeding disk, either directly, see NL1015216, or through sealing elements, see EP 1 637 282 A1, WO 8600833 and U.S. Pat. No. 6,364,035 B1. In the case of devices with the feeding roller, the tightness is obtained by forcing of shaped sealing elements against the rotating feeding roller.

With regard to high pressure in the air system, to provide sufficient tightness for devices with the feeding disk, high manufacturing precision of the main parts of the device, fixed plates and the rotating disk, and also relatively great force for holding fixed plates against the rotating feeding disk, is necessary. This results in fast wearing of relevant friction parts, whereas regular tightness check and tightness adjustment by tightening of fixed plates against the feeding disk is necessary during device operation, what increases operational costs. When relevant parts of the device are worn-out their replacement is then necessary, what basically means replacement of fixed plates and the feeding disk as the main and the most expensive parts of the device. This disadvantage is obvious with device type as described in document NL1015216 C2.

To overcome the disadvantage of wearing-off of the main parts of the device, as mentioned above, solutions were proposed for sealing, which make use of sealing elements placed between the fixed plate and the feeding disk, as described in EP 1 637 282, WO 8600833 and U.S. Pat. No. 6,364,035.

Mentioned solutions provide for that fixed plates do not have to be manufactured with high precision, as it is required for direct contact of the fixed plate and the feeding disk, and when worn-out it is sufficient to replace worn-out sealing elements only.

When using dry ice cleaning machine, it is not always necessary to have the air system work under full working pressure, and therefore, with lower working pressures smaller forces for holding fixed plates against the feeding plate are sufficient for sealing the pressurized part. However, with solutions described in NL1015216 C2 and EP 1 637 282 A1, force exerted by fixed plates is constant and to ensure the tightness, this force is still equal to a force necessary for sealing the highest pressure in the air system, although such a force of fixed plates is not needed. Though in the case of the solution according to EP 1 637 282 A1, worn-out parts replacement costs are not high, the disadvantage of the need to check the tightness and to adjust it by tightening of fixed plates against the feeding disk still stays. This disadvantage is also present with the solutions having rotating feeding roller, where force exerted by shaped sealing elements against the feeding roller must be checked.

Mentioned operational disadvantage present with devices having the feeding disk, is eliminated by solutions according to WO 8600833 and U.S. Pat. No. 6,364,035 B1, where a pressure let to the air system regulates also the amount of force exerted upon the feeding disk, either through sealing elements, when mutual distance of fixed plates is constant, WO 8600833, or through fixed plates, when mutual distance of fixed plates varies, U.S. Pat. No. 6,364,035. Both described devices, although solving the problem of continuous adjustment of the force exerted against the feeding disk as a function of the pressure in the air system, however are complicated in design, what presents higher demands for the maintenance and reparation of such devices and also increase of their production costs.

In the case of solutions U.S. Pat. No. 4,947,592 and CN 2801303 with the feeding roller, exertion of force is realized by mechanical means, springs and adjusting cams.

Aim of the present invention is a device for mixing solid particles of dry ice with the flow of gaseous medium, which eliminates mentioned disadvantages of currently known devices.

SUMMARY OF THE INVENTION

Mentioned aim of the invention is achieved by the device for fixing solid particles of dry ice and the flow of gaseous medium, which comprises feeding element rotatively placed within the fixed housing having openings for the flow of gaseous medium and/or the flow of gaseous medium with solid particles, characterized in that, immovable elastic membrane is placed between the fixed housing and rotatively placed feeding element, whereas the fixed housing is at the side of the elastic membrane provided by at least one sealed pressure chamber connected with the opening for the flow of gaseous medium and/or the opening for the flow of gaseous medium with solid particles.

Immovable elastic membrane placed between the fixed housing and the feeding element performs a function of the sealing element and a function of the sliding element. Elastic membrane is constructionally very simple part, so that its manufacturing and replacement when worn-out, presents only minimal costs. Also, embodiment of the elastic membrane itself and its application in the device according to this technical solution require only minimal modifications of the fixed housing without a need to perform complicated modifications or a need to add further auxiliary elements. These modifications are based on providing the pressure chamber sealed against the external environment directly in the body of the fixed housing. This can be performed by simple machining operations.

Tightness between the rotating feeding element and the fixed housing is ensured by exerting a force on the membrane, which is generated by the pressure of passing flow of the air that is entering the pressure chambers sealed against the external environment. This pressure force thus acts on elastic membranes, and these are forced against the rotating feeding element within constructionally defined space. Pressure force of the elastic membrane varies in relation to the amount of pressure in the pressurized part and thus tightness of the system without a need to regulate mechanical holding force of fixed plates or mechanical holding force of the shaped sealing elements of roller-type device, is realized. On the contrary to complicated system of holding force regulation through pressure in the pressurized part, as known from documents in the state of the art, the elastic membrane and provision of the pressure chambers this technical solution present incomparably simpler solution with undoubted advantages that they provide.

The advantage of application of membranes is also reduction of the friction during rotation of the feeding element by reduction of the friction area to the area of pressure channels only, and also the possibility of fast and simple replacement of sealing surfaces, i.e. membranes.

In the case of devices with feeding disk, pressure release channels are also integral part of the fixed housing, i.e. pressure release means having function of pressure equalization in the feeding disk cavities that already disposed transported granulate and moved to a position out of sealed area, to ambient pressure level.

Devices with the feeding disk have mutual position of fixed plates defined by distancing elements, whereas mutual position of these fixed plates remains constant during the entire time of operation and within the whole range of operational parameters.

BRIEF DESCRIPTION OF DRAWINGS

Technical solution is explained more in detail on attached drawings, where.

DESCRIPTION OF PREFERRED EMBODIMENTS

Figure 1:
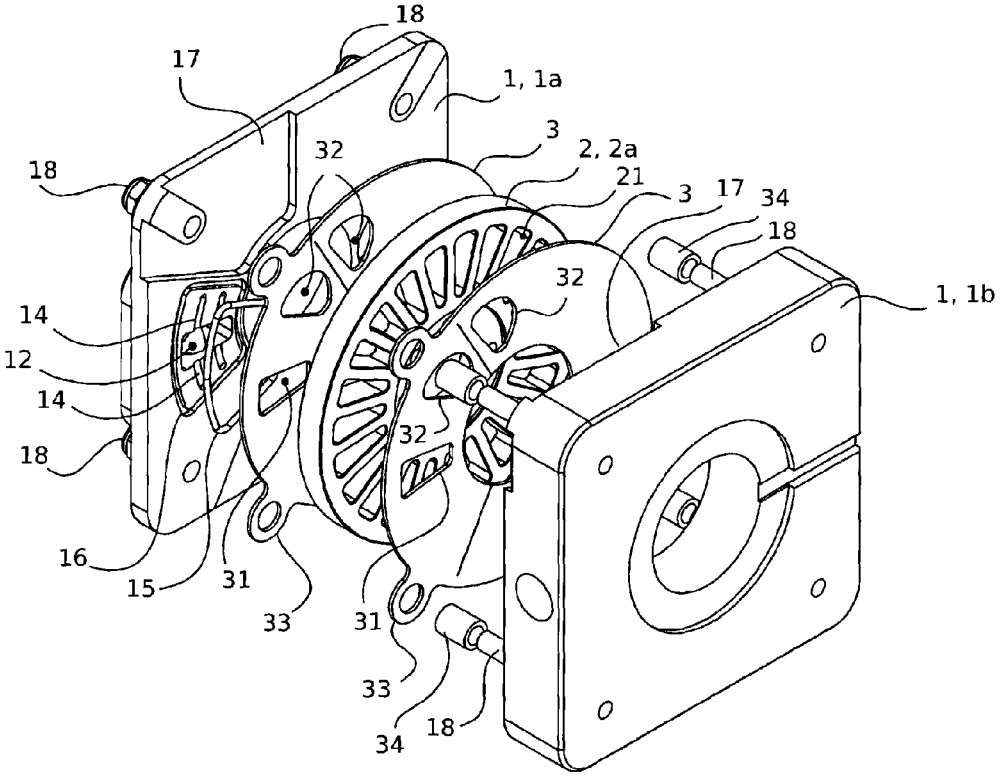
FIG. 1 shows overall exploded view of feeding disk-type device according to this technical solution.
Figure 2:
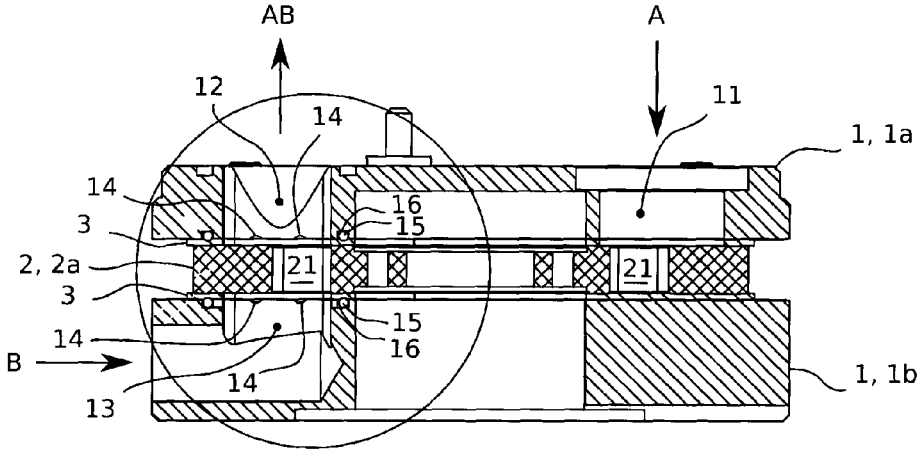
FIG. 2 shows sectional view of feeding disk-type device according to this technical solution.
Figure 3:
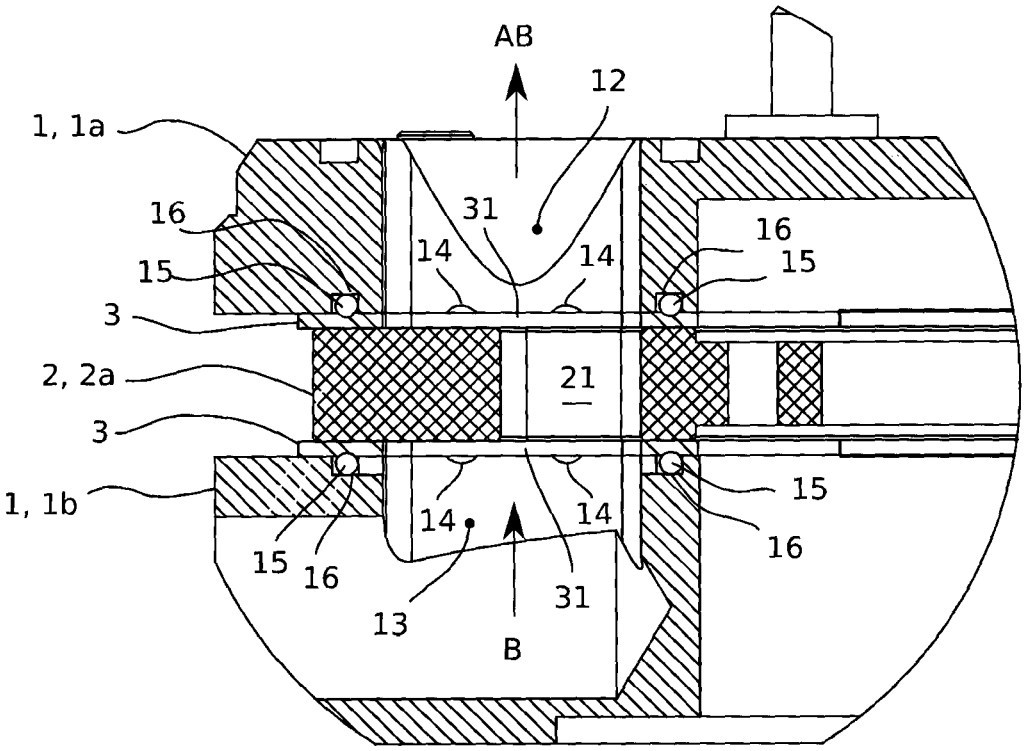
FIG. 3 shows detail of pressurized part of the device from the FIG. 2.

Device for mixing solid particles of dry ice with the flow of gaseous medium according to this technical solution will be further described in the embodiment according to FIGS. 1, 2, 3 and 4. Arrows in figures represent the direction A of dry ice granulate inlet, the direction B of the flow of compressed air and the direction AB of discharge flow of the mixture of air and granulate. FIGS. 1, 2 and 3 relates to feeding disk-type device and FIG. 4 relates to feeding roller-type device.

The device for mixing solid particles of dry ice with the flow of gaseous medium according to FIGS. 1, 2 and 3 comprises fixed housing 1, in this example consisting of fixed plates, wherein feeding element 2 is rotatively placed, in this example the feeding disk 2*a* comprising pattern of transporting cavities 21. The feeding disk 2*a* is rotatively placed between two fixed plates.

Between fixed plates and the feeding disk 2*a* immovable elastic membranes 3 are placed.

One fixed plate, for the sake of clarity in this embodiment, will be referred to as the upper fixed plate 1*a*, comprises the opening 11 for inlet of granulate, or solid particles, of dry ice from a container (not shown) and the opening 12 for discharge of the flow of air with granulate, i.e. the flow of gaseous medium with solid particles. The other fixed plate 1*b*, for the sake of clarity in this embodiment, will be referred to as the lower fixed plate 1*b*, comprises the opening 13 for inlet of the flow of air, i.e. the flow of gaseous medium. The opening 13 for inlet of the flow of air corresponds with the opening 12 for discharge of the flow of air with granulate.

The upper fixed plate 1*a* comprises at the side of adjacent immovable membrane 3, in the area of the opening 12 for discharge of the flow of air with granulate, sealed pressure chamber 14 connected with the opening 12 for discharge of the flow of air with granulate. In this embodiment, sealed pressure chamber 14, is made in the form of two pairs of grooves extending form opposite edges of the opening 12 for discharge of air with granulate. Sealing of the pressure chamber 14, is in this example realized by the sealing 15 placed in the groove 16 created around the opening 12 for discharge of the flow of air with granulate.

In the same manner, lower fixed plate 1*b* comprises at the side of adjacent immovable membrane 3, in the area of the opening 13 for inlet of the flow of air, sealed pressure chamber 14 connected with the opening 13 for inlet of the flow of air. Embodiment of sealed pressure chamber 14, is identical as in above mentioned upper fixed plate 1*a*, and so is the embodiment of sealing of this pressure chamber 14.

Fixed plates 1*a*, 1*b* further comprise pressure release channels 17 for releasing remaining air pressure out of transporting cavities 21 in the feeding disk 2*a*.

Fixed plates 1*a*, 1*b* are further provided by connecting means 18 for their mutual coupling. In this example, connection means 18 are in the form of bolts fastened in the lower fixed plate 1*b*, onto which the upper fixed plate 1*a* is mounted through related holes 19 and fastened by nuts.

Constant mutual position of the upper fixed plate 1*a* and the lower fixed plate 1*b* is secured and defined by distancing elements 34. These distancing elements 34 are in this example realized by distancing sleeves put on bolts. Exactly defined distance between fixed plates 1*a*, 1*b* is essential for correct function of the device.

Immovable elastic membrane 3 comprises holding elements 33 for its immovable fastening in relation to the fixed plate 1*a*, 1*b* and the feeding disk 2*a*. These holding elements 33 are in this example realized integrally with the immovable fixed membrane 3 in the form of eyes put on bolts, i.e. connection means 18 protruding out of the lower fixed plate 1*b*, or on distancing elements 34.

The immovable elastic membrane 3 is provided by the opening 31 for the flow of air, or the flow of air with granulate. It means that, the immovable elastic membrane 3 between the upper fixed plate 1*a* and rotatively placed feeding disk 2*a* comprises the opening 31 for the flow of air with granulate, corresponding with the opening 12 for discharge of the flow of air with granulate, and in the same manner, the immovable elastic membrane 3 between the lower fixed plate 1*b* and rotatively placed feeding disk 2*a* comprises the opening 31 for the flow of air, corresponding with the opening 13 for the flow of air.

The immovable elastic membrane 3 further comprises at least one opening 32 for passage of the remaining air from transporting cavities 21 in the feeding disk 2*a* to the pressure release channels 17 on the fixed plate 1.

During the operation of the device according to this technical from external source of compressed air is blasted-in through the opening 13 for inlet of the flow of air. Granulate from the container of dry ice is led through the opening 11 for inlet of granulate to transporting cavities 21 of the feeding disk 2*a*. With rotation of the feeding disk 2*a*, granulate is transported to the opening 13 for inlet of the air, where the flow of the air discharges granulate from transporting cavities 21, while creating the mixture of air and granulate blasting out of the device through the opening 12 for discharge of the flow of air with granulate. Compressed air passing through the device enters sealed pressure chamber 14, where air pressure is acting upon immovable elastic membranes 3 within the sealed area. The immovable elastic membrane 3 is forced against the feeding disk 2*a* within defined sealed space. Exerted force varies in relation to the amount of pressure in pressurized part, and thus tightness of the system is realized without a need for pressure dependent regulation of holding force of fixed plates 1. As sealing occurs within defined space only, the result is also reduction of friction during rotation of the feeding disk 2*a* by reducing the area of friction to the area of pressure channels 14 only. After discharging of transporting cavities 21, remaining pressure is equalized to ambient pressure when transporting cavities 21 pass by air discharge openings 32 that allow the air with remaining pressure to run out to pressure release channels 17 on fixed plates 1*a*, 1*b*.

Figure 4:
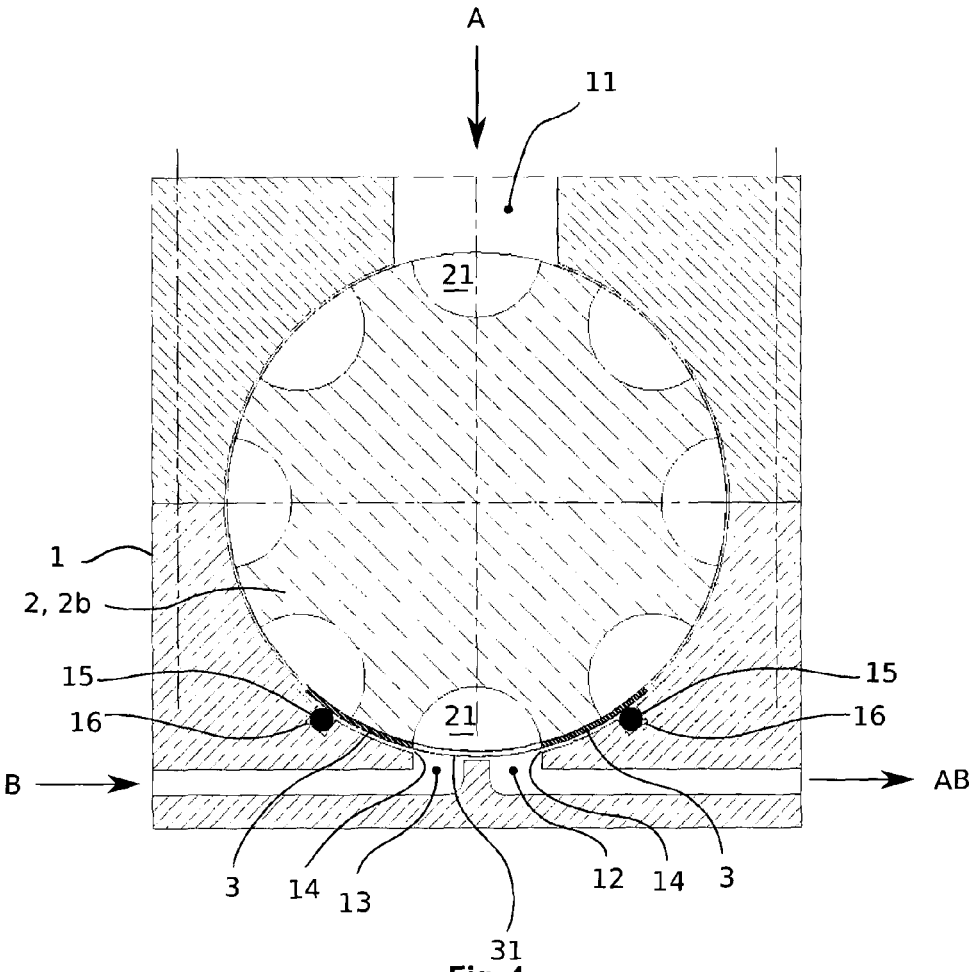
FIG. 4 schematically shows sectional view of feeding roller-type device according to this technical solution.

Embodiment according to FIG. 4 relates to the device comprising feeding roller 2*b* as the feeding element 2.

The device for mixing solid particles of dry ice and the flow of gaseous medium according to FIG. 4 comprises fixed housing 1, wherein feeding element 2 is rotatively placed, in this example the feeding roller 2*b*, which comprises a pattern of transporting cavities 21.

Between the fixed housing 1 and the feeding roller 2*b* immovable elastic membrane 3 is placed.

The fixed housing 1 comprises at one side the opening 11 for inlet of granulate, or solid particles, of dry ice from a container (not shown), and at the other side the opening 13 for inlet of the flow of air, i.e. the flow of gaseous medium and the opening 12 for discharge of the flow of air with granulate, i.e. the flow of gaseous medium with solid particles. The opening 13 for inlet of the flow of air and the opening 12 for discharge of the flow of air with granulate are in this example arranged as it is usual in devices with feeding roller.

The fixed housing 1 comprises at the side of the immovable elastic membrane 3, in the area of the opening 13 for inlet of the flow of air, sealed pressure chamber 14 connected with the opening 13 for inlet of the flow of air. In this example, sealed pressure chamber 14 can be in particular realized as it was described in the embodiment of the device with the feeding disk 2*a*. Tightness of the pressure chamber 14, in this example, is also realized by the sealing 15 placed in the groove 16 created around the opening 13 for inlet of the flow of air.

In the same manner, the fixed housing 1 comprises at the side of adjacent immovable elastic membrane 3, in the area of the opening 12 for discharge of the flow of air with granulate, sealed pressure chamber 14 connected with the opening 12 for discharge of the flow of air with granulate. Embodiment of sealed pressure chamber 14, is identical as mentioned above, and so is the embodiment of sealing of this pressure chamber 14.

During the operation of the device according to this invention, according to FIG. 4, air from external source of compressed air is blasted-in through the opening 13 for inlet of the flow of air. Granulate from the container of dry ice is led through the opening 11 for inlet of granulate to transporting cavities 21 of the feeding roller 2*b*. With rotation of the feeding roller 2*b*, the granulate is transported to the opening 13 for inlet of the air, where the flow of the air discharges the granulate from transporting cavities 21, while creating the mixture of air and granulate blasting out of the device through the opening 12 for discharge of the flow of air with granulate. Compressed air passing through the device enters sealed pressure chamber 14, where air pressure is acting upon the immovable elastic membrane 3 within the sealed area. The immovable elastic membrane 3 is forced against the feeding roller 2*b* within defined sealed space. Exerted force varies in relation to the amount of pressure in pressurized part, and thus rightness of the system is realized. As sealing occurs within defined space only, the result is also reduction of friction during rotation of the feeding roller 2*b* by reducing the area of friction to the area of pressure channels 14 only.

Any elastic (flexible) material with suitable sliding properties and corrosion resistance can be used as material of the elastic membrane 3. In practice, it is mainly stainless steel, or steel with suitable surface treatment, or material based on plastics.

Devices shown in figures and described in examples of embodiments represent particular construction embodiments. These embodiments are introduced as an illustrative example for disclosure of the technical solution. It is obvious that also other construction variants are possible within the idea of this technical solution, e.g. regarding the shape and dimensions of the pressure chamber 14, the way of sealing the pressure chamber 14, the way of securing the elastic membrane 3 to be immovable in relation to the feeding element 2, the arrangement and shape of discharge openings 32 on the elastic membrane 3, etc.

INDUSTRIAL APPLICABILITY

Device according to this invention is designed for mixing solid particles of dry ice with the flow of gaseous medium, especially for generating the blast of solid particles of dry ice for cleaning machines.

What is claimed is:

1. A device for mixing solid particles of dry ice and a flow of gaseous medium, the device comprises a fixed housing having openings for the flow of gaseous medium and/or the flow of gaseous medium with solid particles, a feeding element rotatively placed within the fixed housing, and an immovable elastic membrane placed between the fixed housing and the rotatively placed feeding element, the fixed housing is at a side of the elastic membrane provided with at least one sealed pressure chamber connected with the opening for the flow of gaseous medium and/or the opening for the flow of gaseous medium with solid particles.

2. A device for mixing solid particles of dry ice and the flow of gaseous medium according to claim 1, wherein the fixed housing has fixed plates and also comprises distancing elements between the fixed plates.

* * * * *